US009878545B2

(12) United States Patent
Jefferson et al.

(10) Patent No.: US 9,878,545 B2
(45) Date of Patent: Jan. 30, 2018

(54) WIPER FOR AN INKJET PRINTER

(71) Applicant: HEWLETT-PACKARD DEVELOPMENT COMPANY, L.P., Houston, TX (US)

(72) Inventors: Jafar N. Jefferson, Vancouver, WA (US); Teressa L. Roth, Brush Prairie, WA (US); Jennifer Peterson, Washougal, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

(21) Appl. No.: 15/231,073

(22) Filed: Aug. 8, 2016

(65) Prior Publication Data

US 2016/0339709 A1 Nov. 24, 2016

Related U.S. Application Data

(62) Division of application No. 13/638,328, filed as application No. PCT/US2010/033110 on Apr. 30, 2010, now Pat. No. 9,409,401.

(51) Int. Cl.
*B41J 2/165* (2006.01)

(52) U.S. Cl.
CPC ..... *B41J 2/16535* (2013.01); *B41J 2/16538* (2013.01)

(58) Field of Classification Search
None
See application file for complete search history.

(56) References Cited

U.S. PATENT DOCUMENTS

| | | | | |
|---|---|---|---|---|
| 5,500,660 | A | 3/1996 | Childers et al. | |
| 6,702,423 | B2 | 3/2004 | Okamura et al. | |
| 6,883,897 | B2 | 4/2005 | Kinoshita et al. | |
| 2002/0122092 | A1 * | 9/2002 | Okamura | B41J 2/16547 347/33 |
| 2005/0062796 | A1 | 3/2005 | Mott et al. | |
| 2008/0218553 | A1 | 9/2008 | Ito | |

FOREIGN PATENT DOCUMENTS

| | | |
|---|---|---|
| CN | 2209591 | 10/1995 |
| CN | 1468715 | 1/2004 |
| CN | 2790759 | 6/2006 |

(Continued)

OTHER PUBLICATIONS

PCT Search Report dated Feb. 7, 2011, 9 pgs.

*Primary Examiner* — Alejandro Valencia
(74) *Attorney, Agent, or Firm* — HP Inc. Patent Department

(57) ABSTRACT

In an inkjet printer having a small print head assembly and a large print head assembly, a wiper includes a first wiper section having a width approximately equal to a width of an orifice area of the small print head assembly, a decoupler adjacent to the first wiper section, a second wiper section adjacent to the decoupler, where the first and the second wiper sections and the decoupler combined have a width approximately equal to a width of an orifice area of the large print head assembly, and a squared tip at an extremity of the single, segmented wiper to impede wicking action. A tab holds the wiper oriented so as to wipe the print head assemblies in a direction of a printing operation.

19 Claims, 9 Drawing Sheets

(56) References Cited

FOREIGN PATENT DOCUMENTS

| | | |
|---|---|---|
| DE | 69909888 | 5/1999 |
| DE | 69723948 | 9/2004 |
| DE | 69614063 | 6/2006 |
| EP | 0960735 | 12/1999 |
| JP | 6023999 | 2/1994 |
| JP | 2000006437 | 1/2000 |
| JP | 2005067028 | 3/2005 |
| JP | 2005212165 | 8/2005 |

* cited by examiner

WIPER FOR AN INKJET PRINTER

CROSS-REFERENCE TO RELATED APPLICATIONS

This application is a Divisional of copending U.S. patent application Ser. No. 13/638,328, filed on Sep. 28, 2012, and incorporated herein by reference in its entirety, which claims priority to International Application Serial No. PCT/US2010/033110, filed Apr. 30, 2010, and incorporated herein by reference in its entirety.

BACKGROUND

Typical inkjet printers employ one or more print head assemblies, each of which includes an orifice plate having formed in an orifice area therein, hundreds of very small orifices through which ink is sprayed on to a print medium. Because the small diameter orifices are susceptible to clogging, these inkjet printers may use some type of wiping mechanism or system to remove debris and accumulated ink from the orifice area. The wiping mechanism may include means for creating a wicking action. This wiping process often is noisy. Moreover, the multiple print head assemblies may be of different sizes and topographies, so that a wiping mechanism ideally suited for one type of print head assembly is not so well suited for another type of print head assembly. For example, many inkjet printers employ a color-ink print head assembly and a black-ink print head assembly. The black-ink print head assembly typically is larger (wider) than the color-ink print head assembly, and a wiping system optimized for the black-ink print head assembly might not be effective in wiping the orifice area of the color-ink print head assembly. A solution that uses multiple wipers, each sized for the appropriate print head assembly, adds cost and size to the inkjet printer. This solution may be impractical for a small and/or intended low-cost printer.

DESCRIPTION OF THE DRAWINGS

The Detailed Description will refer to the following drawings in which like numerals refer to like items, and in which.

DETAILED DESCRIPTION

An exemplary inkjet printer employs two or more print head assemblies, each of which includes an orifice plate having formed in an orifice area therein, hundreds of very small orifices through which ink is sprayed on to a print medium (e.g., a piece of paper). In a particular example, the inkjet printer includes a color-ink print head assembly and a black-ink print head assembly. Because of the small diameter of the individual orifices in the color- and black-ink print head assembly orifice plates, a wiping mechanism is used to remove debris and accumulated ink from the orifice areas of the assemblies.

To improve the wiping process, a single, compliant wiper, which in an embodiment includes features to accommodate dry wiping, and having a segmented blade section, and corresponding wiper system are disclosed. In an embodiment, the single, compliant wiper is installed perpendicular (i.e., approximately 90 degrees) to the wiping direction. In another embodiment, the single, compliant wiper is installed at an angle (e.g., about ten degrees off perpendicular) to the wiping direction. The thus-configured single, compliant wiper and corresponding wiper system provides for effective wiping of different size and topography orifice plates while maintaining a low cost wiping implementation, and further provides for much improved acoustics during the wiping process.

More specifically, a segmented wiper blade portion of a single, compliant wiper is used to wipe two different-size print head assemblies. The single, compliant wiper is held in a fixed location while a carriage that houses the print head assemblies carries the print head assemblies past the segmented wiper blade. Upon contacting the print head assemblies, the segmented wiper blade bends over as it slides across each print head assembly and removes debris from the print head assembly orifice areas.

Figure 1A:
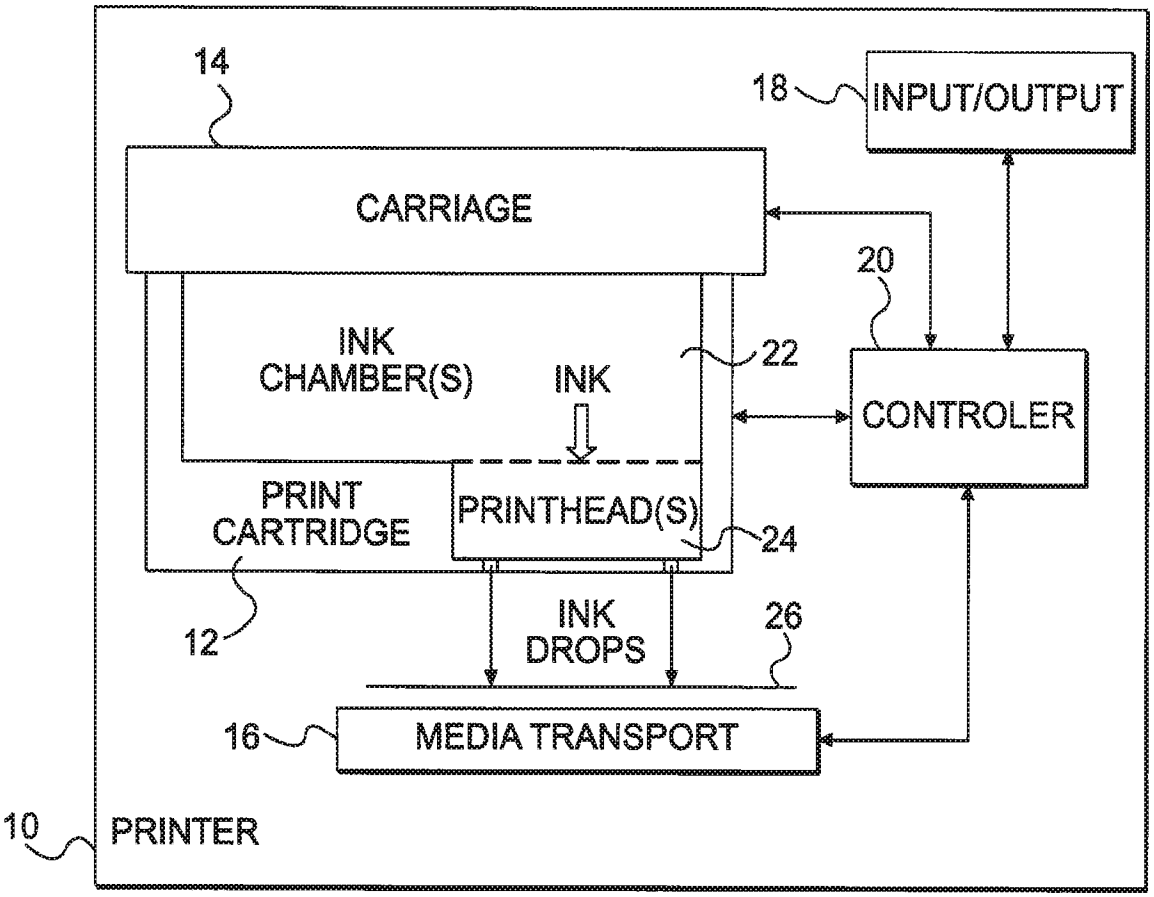
FIG. 1A illustrates, in block diagram form, one example embodiment of an inkjet printer in which the disclosed embodiments of a wiper may be implemented.

FIG. 1A shows, in block diagram form, an embodiment of an inkjet printer in which the disclosed embodiments of a wiper may be implemented. In FIG. 1, inkjet printer 10 includes a print cartridge 12, a carriage 14, a print media transport mechanism 16, an input/output device 18, and a printer controller 20 connected to each of the operative components of printer 10. Print cartridge 12 includes one or more ink holding chambers 22 and one or more print head assemblies 24. A print cartridge is sometimes also referred to as an ink pen or an ink cartridge. Print head assembly 24 represents generally a small electromechanical part that contains an array of miniature thermal resistors or piezoelectric devices that are energized to eject small droplets of ink out of an associated array of orifices. A typical thermal inkjet print head assembly, for example, includes an orifice plate arrayed with ink ejection orifices and firing resistors formed on an integrated circuit chip. Each print head assembly is electrically connected to the printer controller 20 through external electrical contacts. In operation, the printer controller 20 selectively energizes the firing resistors through the electrical contacts to eject a drop of ink through an orifice on to the print media 26.

Print cartridge 12 may include a series of stationary cartridges or print head assemblies that span the width of the print media 26. Alternatively, the cartridge 12 may include one or more cartridges that scan back and forth on the carriage 14 across the width of the print media 26. Other cartridge or print head assembly configurations are possible. A movable carriage 14 may include a holder for the print cartridge 12, a guide along which the holder moves, a drive motor, and a belt and pulley system that moves the holder along the guide. Media transport 16 advances the print media 26 lengthwise past the print cartridge 12 and the print head assembly 24. For a stationary cartridge 12, the media transport 16 may advance the print media 26 continuously past the print head assembly 24. For a scanning cartridge 12, the media transport 16 may advance the print media 26 incrementally past the print head assembly 24, stopping as each swath is printed and then advancing the print media 26 for printing the next swath. Controller 20 may communicate with external devices through the input/output device 18, including receiving print jobs from a computer or other host device. Controller 20 controls the movement of the carriage 14 and the media transport 16. By coordinating the relative position of the print cartridge 12 and the print head assembly 24 with the print media 26 and the ejection of ink drops, the controller 20 produces the desired image on the print media 26.

Figure 1B:
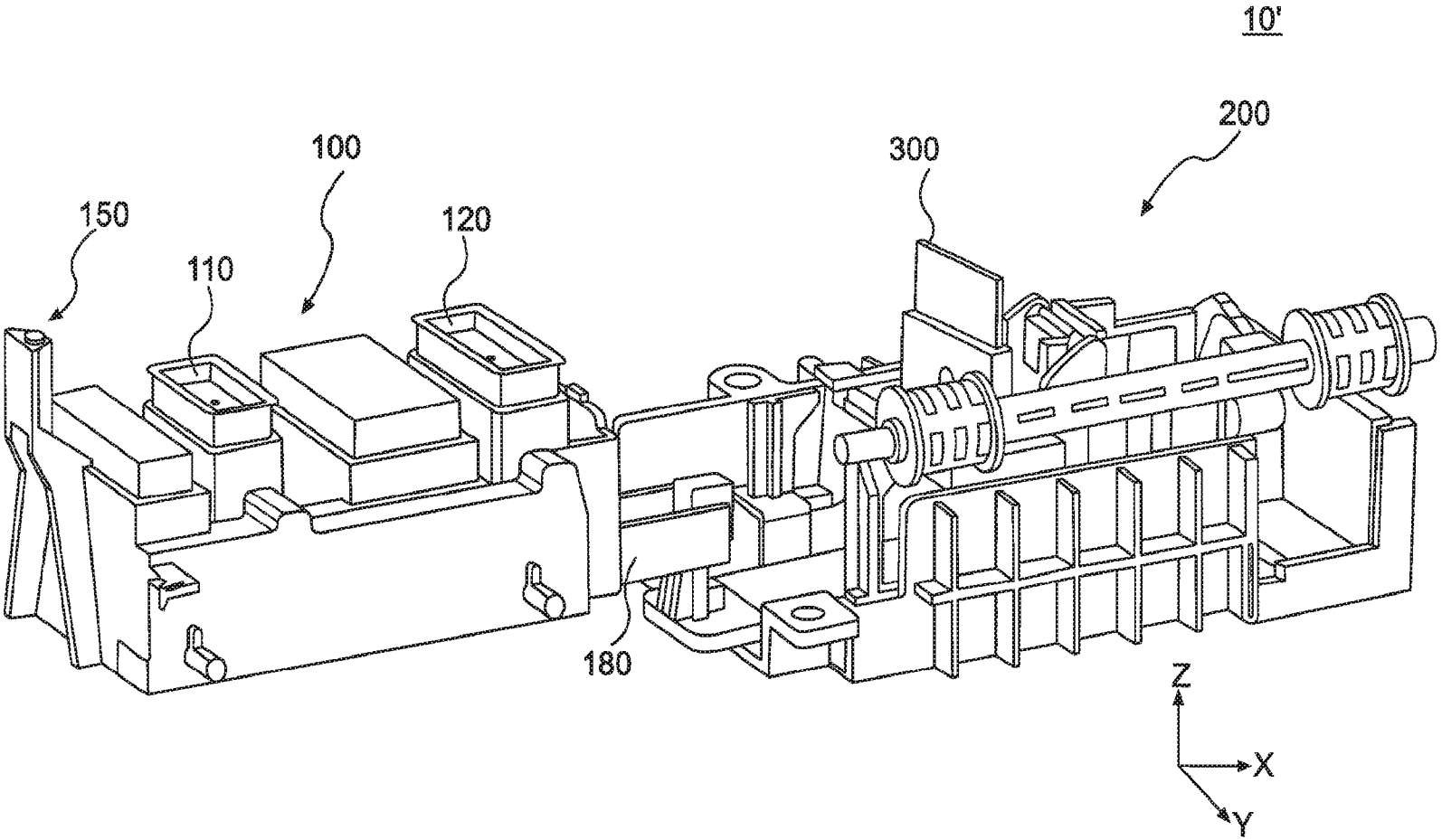
FIG. 1B is a perspective view of selected components of the inkjet printer of FIG. 1A employing example embodiments of a wiper.

FIG. 1B is a perspective view of selected components of the inkjet printer of FIG. 1A in which are installed example embodiments of a single, compliant wiper. In FIG. 1B, components 10' of the inkjet printer 10 include a cap sled 100 that includes cap 110 for capping a color-ink print head assembly and cap 120 for capping a black-ink print head assembly. The cap sled 100 is moved in the −X direction by a force applied at cap sled pin 150, and moves back in the +X direction by operation of a return spring (not shown). The force applied at the cap sled pin 150 is generated by operation of the print head assembly carriage (not shown).

Also shown in FIG. 1B is wiper assembly 200, which is connected to the cap sled 100 by connection 180 so that as the cap sled 100 is pushed in the X direction, a single, compliant wiper 300 is positioned for a wiping process. The wiper assembly 200 contains pivotable wiper mount 210 (see FIG. 3), which houses and supports an example of an embodiment of the single, compliant wiper 300. Because it is pivotable, the wiper mount 210 may be raised into the position shown in FIG. 1B to allow wiping of the print head assemblies. The X direction motion of the cap sled 100 causes the pivotable wiper mount 210 to pivot into the position to allow wiping. When raised to the wiping position, movement of the print head assembly carriage in the −X and +X directions causes the orifice area of each of the print head assemblies to contact the wiper 300. When the desired wiping process is complete, the pivotable wiper mount 210 is lowered to allow printing by the inkjet printer.

Figure 2:
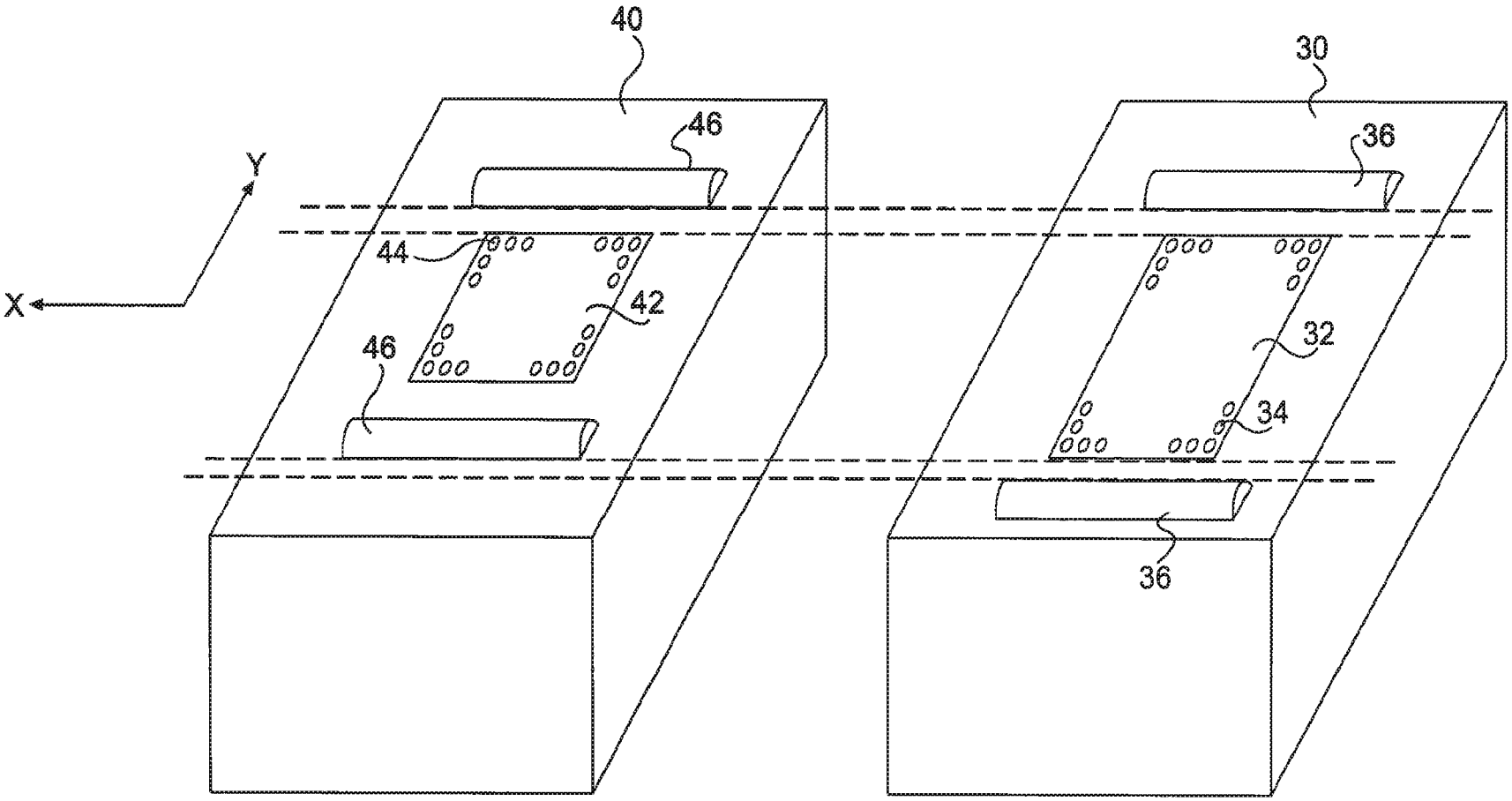
FIG. 2 illustrates, schematically, an example embodiment of surfaces of color- and black-ink print head assemblies used in the inkjet printer of FIG. 1A.

FIG. 2 illustrates, schematically, the generally planar surfaces of the color- and black-ink print head assemblies in the area of the orifice plates. Color-ink print head assembly 40 includes orifice area 42 having a number of orifices 44 arranged in columns along the Y-axis. At either end of the orifice columns are small sections of the orifice area in which no orifices are formed, followed by encapsulants 46 that contain electrical connections between an ink ejection mechanism and printer electrical control circuits. Black-ink print head assembly 30 includes orifice area 32 having a number of orifices 34 arranged in columns. At the end of each column are orifice-free sections followed by encapsulants 36. The encapsulants 46 and 36 are raised slightly above the generally planar orifice areas 42 and 32. To effectively wipe the orifice areas, any contact between the wiper and any of the encapsulants 46, 36 should be minimized; otherwise, the wiper could rise above the surface of the orifice areas 42, 32, which could in turn lead to ineffective wiping of some or all of the orifice area. As can be appreciated from FIG. 2, an ordinary single wiper designed to wipe the entire orifice area inside the encapsulants 36 will ride over at least one of the encapsulants 46, possibly leading to ineffective wiping of at least the color-ink orifice area 42. The wiper 300 of FIG. 1B overcomes this problem of wiping two different size orifice areas with a single, compliant wiper having a segmented blade section.

Figure 3:
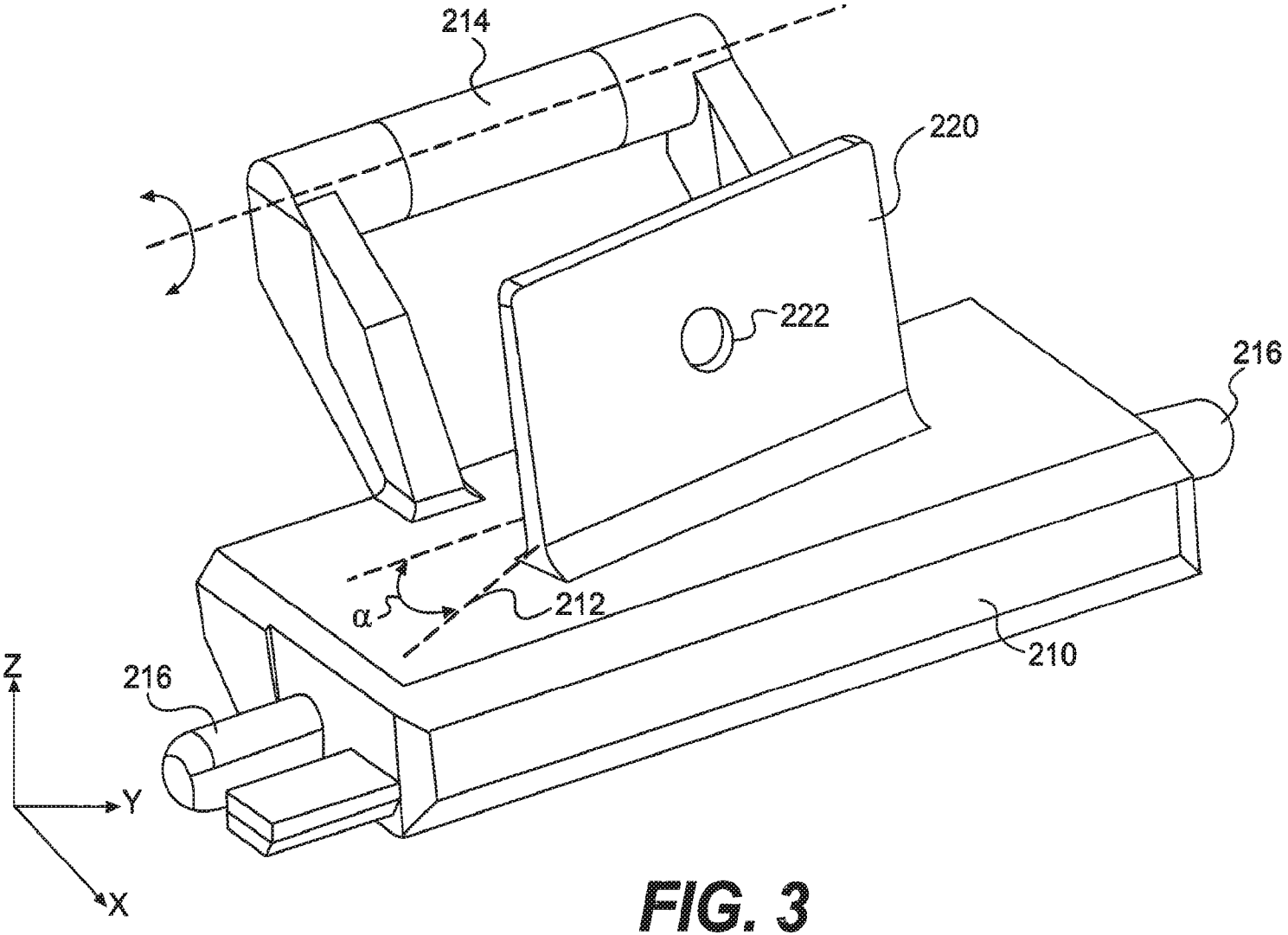
FIG. 3 is a perspective view of an example embodiment of a wiper mount for holding a wiper.

FIG. 3 is a perspective view an example embodiment of a wiper mount for holding a single, compliant wiper. As shown in FIG. 3, pivotable wiper mount 210 includes pivot base 212, pivot arm 214, and Y-axis locators 216. Also shown is wiper tab 220, which, in the illustrated embodiment, is installed at an angle $\alpha$ from the Y-axis, where a is a small angle. The angled wiper tab 220 is designed to securely hold single, compliant wiper 300 by way of an interference fit, and to correctly align the wiper 300 using assembly pin 222 for this purpose. As thus installed on the wiper tab 220, the wiper 300 wipes print head assemblies in a direction generally orthogonal to a print axis of the inkjet printer 10 (i.e., as shown, at $90-\alpha$ degrees).

Figure 4A:
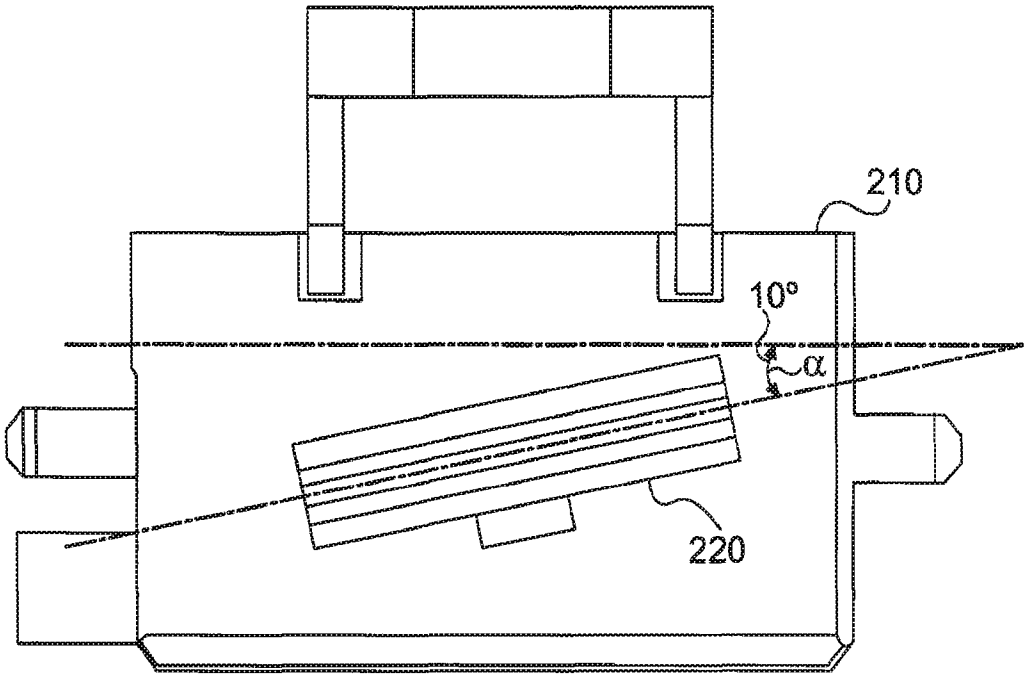
FIG. 4A is a top planar view of the wiper mount of FIG. 3.

FIG. 4A is a top planar view of the example embodiment of the pivotable wiper mount 210. As can be seen, the wiper tab 220 is formed on the mount 210 at the small angle $\alpha$, which, in an embodiment, is approximately ten degrees.

Figure 4B:
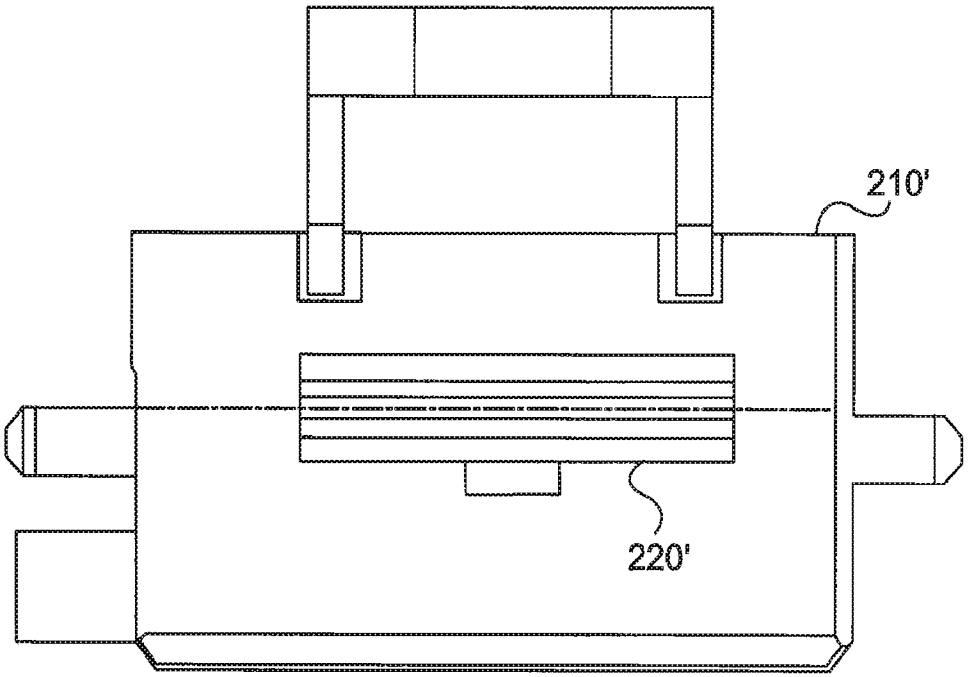
FIG. 4B is a top planar view of an alternate example embodiment of a wiper mount.

FIG. 4B illustrates another example embodiment of a pivotable mount and the relationship to a corresponding wiper. In FIG. 4B, pivotable mount 210' has fixed thereon, wiper tab 220' The wiper tab 220' is fixed on the wiper mount 210' so that a long axis of the wiper tab 220' is approximately orthogonal to a direction of a printing operation. That is, the dashed line in FIG. 4B aligns with the Y-axis (see FIG. 1B) without any inclination by a small angle, such as the small angle $\alpha$ shown in FIG. 4A.

Figure 5A:
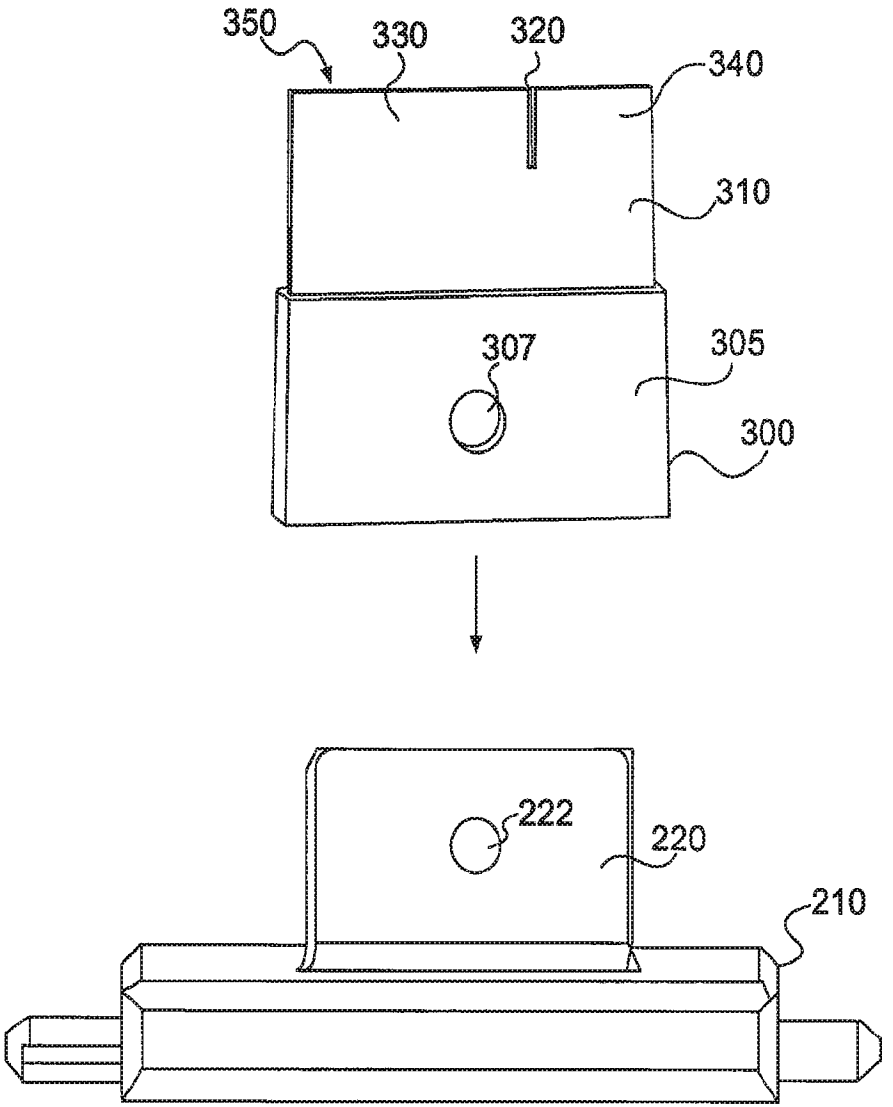
FIG. 5A illustrates a relationship between the wiper mount of FIG. 3 and a corresponding example embodiment of a single, compliant wiper.

FIG. 5A illustrates an example embodiment of the wiper mount of FIG. 4A, showing a relationship between the mount 210 and a corresponding example of an embodiment of a single, compliant wiper 300. The wiper 300 includes base section 305, which slides over the wiping tab 220 to achieve an interference fit. As can be seen, the base section 305 of the wiper 300 includes assembly location hole 307 into which fits corresponding assembly pin 222. Aligning the assembly pin 222 with the assembly location hole 307 ensures the correct orientation and alignment of the wiper 300 on the wiper tab 220. The wiper 300 achieves an interference fit when fully installed on the wiper tab 220. The wiper 300 also includes segmented wiper blade 310, which in turn includes a first wiper section 330 and a second wiper section 340 separated by decoupler 320. As will be discussed later, the decoupler 320 may be a zero-width (0.0 mm) slit or a narrow slot, which in an embodiment may have a width of 0.3 mm. Furthermore, the decoupler 320 may be formed during formation of the wiper 300, or at some time subsequent.

As can be seen from FIG. 5A, the wiper base 305 is thicker, and thus stiffer, than the wiper blade 310. The wiper base 305 also is thicker to accommodate mounting the wiper 300 on the wiper tab 220. Furthermore, the wiper blade 310, in an embodiment, tapers in the +Z direction. In another embodiment, the wiper blade 310 has a uniform cross section throughout its length. As will be discussed later, these characteristics of the wiper 300 allow the tip, or edge area of the wiper blade 310 to deform, or curl, slightly during the wiping process while the remainder of the wiper 300 maintains its as-molded shape. This curling of the wiper blade 310, in conjunction with the small angle of the wiper 300, causes generally Y-axis translation of the sections 330 and 340 (i.e., in a direction generally orthogonal to the wiping (X) axis) so as to effectively sweep the path that otherwise would be left by the decoupler 320. Finally, in a dry wiping embodiment of the wiper 300, the first and second wiper sections 330, 340 are defined by flat top surface 350. That is, the top edge of the wiper 300 is square. This configuration largely eliminates any wicking action such as that which would occur were the top edge of the wiper 300 rounded. Wicking has the disadvantage that it pulls ink onto the surface of the orifice plate. That ink accumulates, may dry, and gets flicked onto other printer surfaces, and attracts and retains debris at the orifice plate and the wiper. By eliminating a wicking action, the wiper 300 can ensure generally dry wiping of the orifices.

The wiper 300 may be molded as a monolithic entity, with the decoupler 320 formed during the molding process. Alternately, the wiper 300 may be molded and the decoupler 320 later cut into the wiper blade 310. The wiper 300 is molded from a pliable material that can hold its as-molded shape with little distortion except, as mentioned above, and as will be described below, at a top edge of the wiper 300. In an embodiment, the wiper 300 is molded from a thermoplastic elastomer (TIDE) such as Santoprene™, 73 durometer, for example.

The exemplary single, compliant wiper system includes the segmented wiper blade molded in one piece to the wiper base, and a wiper tab to locate, position, and securely hold the wiper at a small angle relative to a direction of motion of the print head assemblies during the wiping process. The system also may include a wiper mount that pivots to place the wiper in position for wiping, and other support and locating mechanisms.

As noted above, debris accumulated on the orifice area can partially or fully block the trajectory of ink drops that are, or are intended to be, ejected through the orifices. This blockage can have a deleterious affect on print quality and printer function. To prevent these unwanted effects, the single, compliant wiper 300 is designed to sweep the area of the orifice plates between the encapsulants such that the wiper 300 makes intimate contact over the entire area containing the orifices. Because the encapsulants are raised above the surface of the orifice area, the wiper 300 must ride in the area between the encapsulants. If a wiper was oversized, or mis-aligned, the wiper could contact the encapsulants and be lifted away from intimate contact with the orifice plate in the area of the encapsulants and thus could fail to remove some debris from the orifice area.

Furthermore, one of the problems that arises when an inkjet printer uses more than one print head assembly, particularly if the assemblies are of a different size (one large, one small; for example, the assemblies shown in FIG. 2) is that a single wiper sized to wipe one assembly might not be effective at wiping the other assembly. On one side of the wiper, the encapsulants may line up well such that the wiper can be aligned to not ride over the encapsulants on that side. However, on the other side, the encapsulants will not line up, and the wiper will be lifted off the orifice area. To overcome this problem, the wiper 300, as can be appreciated from FIG. 5A, is designed such that the entire width of the segmented wiper blade 310 is used to wipe the larger assembly (i.e., the black-ink print head assembly) and only the section 330 is used to wipe the smaller assembly (i.e., the color-ink print head assembly) while the section 340 rides up on the encapsulant.

However, the segmented wiper blade 310 may leave an area of the orifice plate of the large printer head assembly un-wiped. More specifically, the area swept by the decoupler 320 may not be cleared of debris during the wiping process. When necessary to account for the presence of the decoupler 320, the wiper 300 is angled (for example, at ten degrees) so that a +X-direction wipe followed by a −X-direction wipe will completely wipe the larger print head assembly orifice plate. With this angle, the top edge of the wiper blade 310, which will bend over during any wiping process, will slide slightly in the +Y- or −Y-direction. This slight Y-axis translation of the wiper blade top edge will cover the area of the orifice plate that would otherwise be un-swept with wiper 300 in a non-angled orientation. In an embodiment, this Y-direction shift is about 0.7 mm, or about five percent of the total width of the segmented wiper blade 310.

Figure 5B:
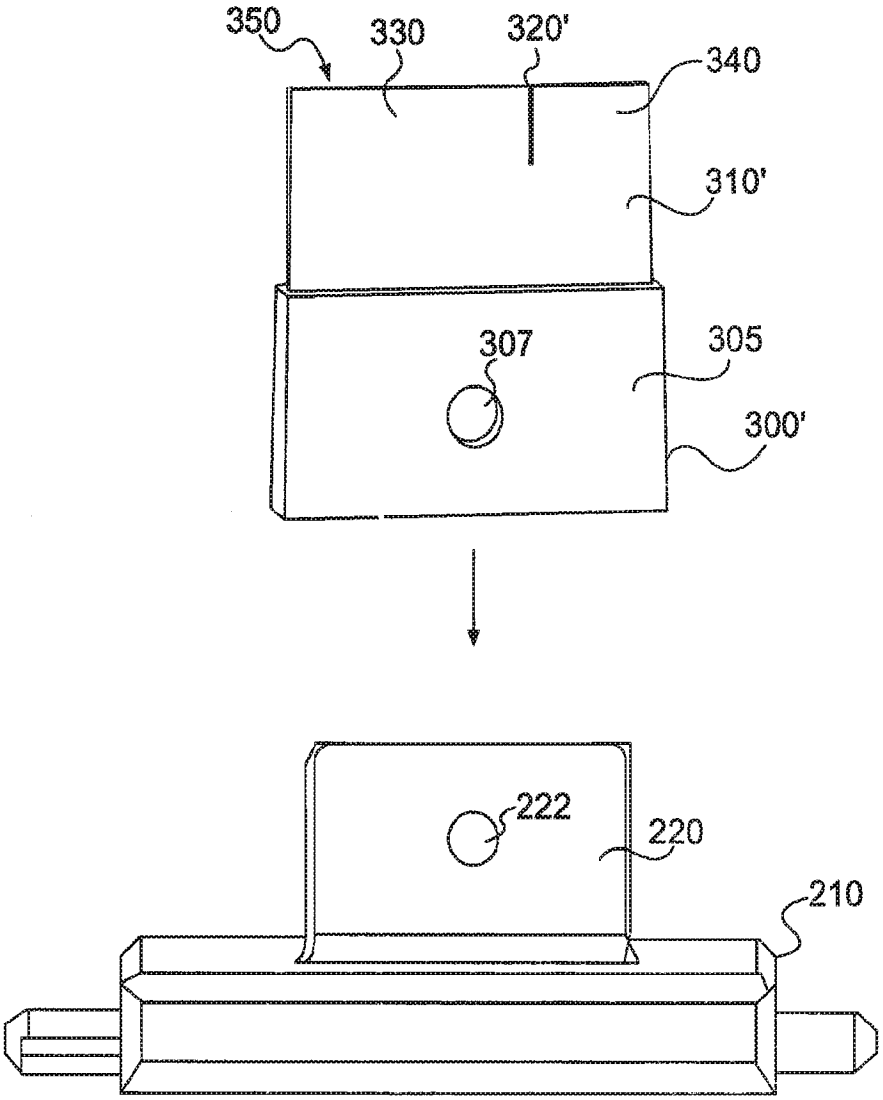
FIG. 5B illustrates a relationship between the wiper mount of FIG. 4B and a corresponding example embodiment of a single, compliant wiper.

FIG. 5B illustrates a relationship between a pivotable wiper mount and an alternate wiper. In FIG. 5B, wiper mount 210 accommodates wiper 300'. Wiper 300' includes segmented blade 310' connected to base 305. The segmented blade 310' includes first segment 330, which is sized to approximate the width of a first, or small print head assembly orifice area (i.e., the segment 330 is able to sweep between the encapsulants 46 of color-ink print head assembly orifice area 42 (the smaller of the two areas—see FIG. 2)) with possible minor contact with one of the encapsulants 46. Second segment 340 is sized so that a combined width of the first and the second segments 330, 340 is able to sweep between the encapsulants 36 (see FIG. 2) with possible minor contact with either of the encapsulants 36. Such minor contact should not be sufficient to lift the wiper off the orifice area to a degree that would more than slightly affect the wiping efficiency. Decoupler 320' separates the segment 330 and the segment 340. The decoupler 320' is a "zero-width" (i.e., a width of zero mm) slit between the two segments. The decoupler 320' prevents deformation or wiping action of one segment from affecting the other segment. For example, when wiping the orifice area 42, the segment 340 will ride up over an encapsulant 46. Without the decoupler 320', this lifting effect could affect the wiping action of the segment 330. When wiping the black-ink print head assembly orifice area (i.e., the larger of the two areas shown in FIG. 2), both segments 330 and 340 are used for wiping, and the "zero-width" decoupler does not cause parts of the wiping path to be missed. The decoupler 320' may be formed subsequent to the molding of the wiper 300'.

Figure 6:
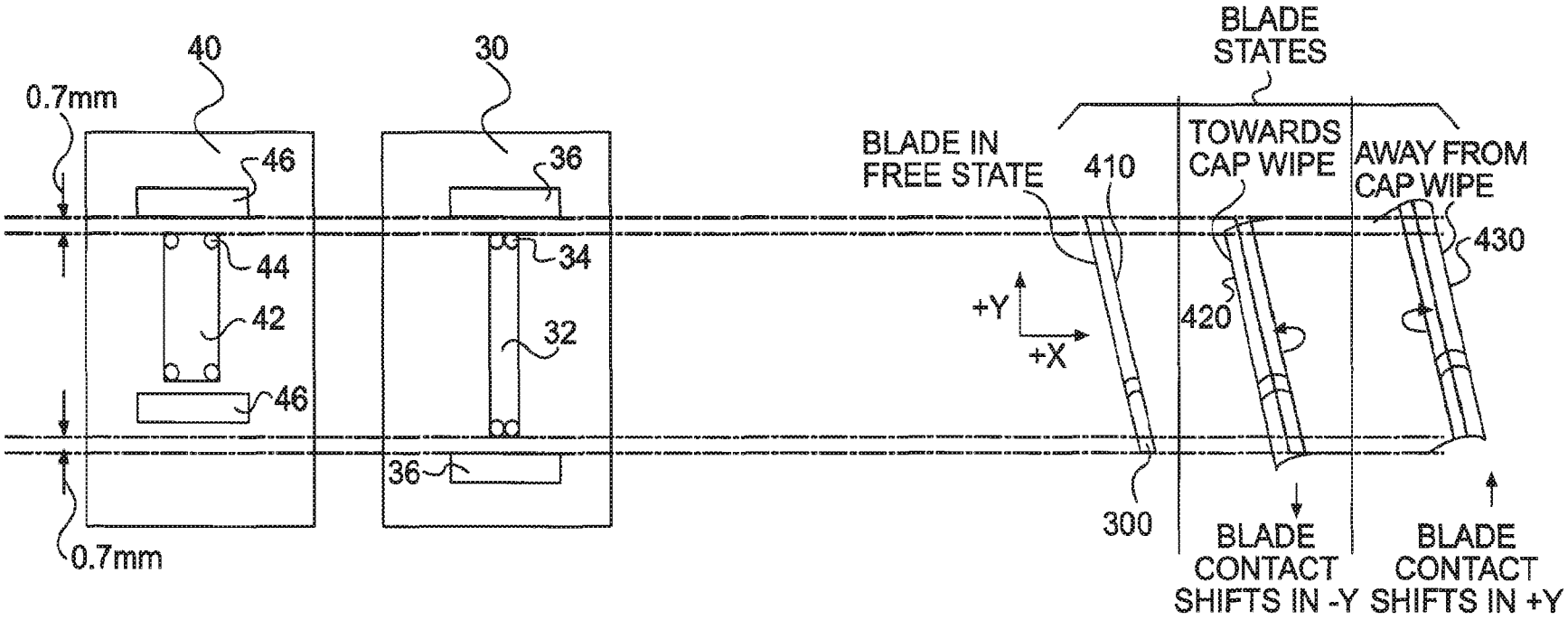
FIG. 6 illustrates an example embodiment of a wiping operation of the exemplary single, compliant wiper of FIG. 5A.

FIG. 6 illustrates schematically an exemplary wiping operation of the exemplary single, compliant wiper 300, including the effect of angling the wiper 300 through the small angle $\alpha$. In FIG. 6, color-ink print head assembly 20 includes orifice area 42 having a number of orifices 44 arranged in columns along the Y-axis. At either end of the orifice columns are small sections of the orifice area in which no orifices are formed followed by encapsulants 46 that contain the electrical connections between an ink ejection mechanism and printer electrical control circuits. Black-ink print head assembly 30 includes orifice area 32 having a number of orifices 34 arranged in rows and columns. At the end of each row are orifice-free sections followed by encapsulants 36. The encapsulants 46 and 36 are raised slightly above the generally planar orifice areas 42 and 32. The single, compliant wiper 300 is shown in three states: In a free state 410, the segmented wiper blade 310 is not in contact with any portion of the print head assemblies, and so is not bent over in any direction. In a forward wiping state 420, the segmented wiper blade 310 bends over in a counter clockwise direction causing a translation of the blade tip in the −Y direction. In a reverse wiping state 430, the segmented wiper blade 310 bends over in a clockwise direction causing a +Y direction translation. Thus, by using a forward and a reverse wiping motion, the different size orifice areas can be effectively wiped of debris by the single, compliant wiper 300. That is, the bi-directional shift of the segmented wiper blade 310 causes the location of any area that would otherwise be untouched because of the decoupler 320 also to shift. Although a small angle, the angle of the single, compliant wiper 300 is large enough that there is no overlap of the untouched area from forward to reverse wiping motions. Thus, an inkjet printer using the single, compliant wiper 300 is in contrast to current inkjet printers, which typically employ two or more wipers to account for the size variation in print head assemblies. These more complex wiper systems take up more space and cost more money than the single, compliant wiper 300.

Angling the single, compliant wiper 300 provides other significant benefits. First, as noted above, creating a printer wiping system that consistently aligns the wiper blade to the orifice plate is a significant challenge, especially when the area between the outermost orifices and the encapsulants is small. Using the wiper 300 and bi-directional wiping, it is only necessary for the wiper blade to be aligned properly on at least one pass of the wiping process. Because of the bi-directional shift, the wiper 300 effectively covers two different swept paths across the orifice plate. If the wiper alignment is offset from its nominal value (e.g., due to manufacturing variations), the bi-directional shift will, when the carriage travels in one direction, compensate for the offset and when the carriage travels in the opposite direction, will exaggerate the offset.

A second further benefit of angling the wiper 300 is an improvement in the quality of acoustics that accompanies a wiping process. For an un-angled wiper, the energy stored in a bent over wiper blade is released all at once when the wiper blade clears the print head assembly. In contrast, an angled wiper, such as the wiper 300, which gradually engages and disengages from the print head assembly, spreads the energy release out over time, thereby reducing its magnitude and making the wiping process much less noticeable to a user.

While the single, compliant wiper described above is disclosed as having a first and a second blade section, the concept of a segmented wiper blade could be extended to more than two blade sections so as to accommodate three or more different-sized print head assemblies and also could be extended to accommodate other print head topology differences other than just those disclosed herein. In addition, the herein disclosed single, compliant wiper with multiple blade segments can be extended to use in inkjet printers having print head assemblies that are aligned at different ends of the inkjet printer.

We claim:

1. A wiper for use in an inkjet printer, comprising:

a base that secures the wiper in the inkjet printer at an acute angle with respect to a wiping axis; and a blade adjacent the base portion, comprising:

a first blade section having a width approximately equal to a width of an entire orifice area of a small print head assembly;

a second blade section that, in combination with the first blade section, has a width approximately equal to a width of an entire orifice area of a large print head assembly, wherein the large print head assembly is a separate print head assembly from the small print head assembly; and a decoupler between the first and second blade sections such that the second blade section does not affect a wiping action of the first blade section.

2. The wiper of claim 1, wherein the first and second blade sections terminate in squared ends, wherein wicking during the wiping action is impeded.

3. The wiper of claim 1, wherein the wiper is molded from a thermoplastic elastomer.

4. The wiper of claim 1, wherein the blade further comprises a square edge formed at an extremity of the wiper, at least a portion of the square edge contacting the orifice area during a wiping process, whereby the wiping process is completed with wicking impeded.

5. The wiper of claim 4, wherein the blade tapers from the base to the square edge, wherein the blade is stiffer adjacent the base than at the extremity of the blade, and wherein the blade deforms during the wiping process.

6. The wiper of claim 1, wherein, the wiper is mounted such that a wiping process causes translation of one or both of the first and second blade sections across the width of the small and large orifice areas and approximately orthogonal to the wiping axis.

7. The wiper of claim 6, wherein the wiper mounts at an angle that is approximately ten degrees from the wiping axis, and wherein the translation comprises approximately five percent of a width of the blade.

8. The wiper of claim 1, wherein, in a forward wiping state of a wiping process, a tip of the blade is to translate in a first direction approximately orthogonal to the wiping axis, and, in a reverse wiping state of the wiping process, the tip of the blade is to translate in a second direction opposite the first direction.

9. The wiper of claim 1, wherein the first blade section is to wipe the small print head assembly orifice area, and wherein the first blade section combined with the second blade section is to wipe the large print head assembly orifice area.

10. The wiper of claim 1, wherein the decoupler is formed in the wiper from an extremity of the wiper to a depth less than a full height of the wiper.

11. The wiper of claim 1, wherein, the wiper is mounted such that a wiping process causes translation of one or both of the first and second blade sections across the width of the orifice areas and approximately orthogonal to a direction of movement of the wiper during the wiping process.

12. The wiper of claim 11, wherein the wiper mounts at an angle that is approximately ten degrees from the wiping axis, wherein the translation of one or both of the blade sections comprises a distance of approximately five percent of a width of the blade, and wherein acoustic quality accompanying the wiping process is improved.

13. The wiper of claim 1, wherein, in a forward wiping state of a wiping process, a tip of the blade is to translate in a first direction approximately orthogonal to a direction of the wiping process, and, in a reverse wiping state of the wiping process, the tip of the blade is to translate in a second direction opposite the first direction.

14. The wiper of claim 1, wherein the first blade section is to wipe the small print head assembly orifice area, and wherein the first blade section combined with the second blade section is to wipe the large print head assembly orifice area.

15. The wiper of claim 1, wherein the first and the second blade sections and the decoupler comprise a full width of the blade of the wiper.

16. The wiper of claim 1, wherein the decoupler is formed in the wiper from an extremity of the wiper to a depth less than a full height of the wiper.

17. The wiper of claim 1, wherein a wiping action by the first blade section wipes approximately a full width of the small print head assembly orifice area, and wherein the wiping action by the first blade section combined with a wiping action by the second blade section wipes approximately a full width of the large print head assembly orifice area.

18. The wiper of claim 1, wherein the first blade section is wider than the second blade section.

19. The wiper of claim 1, wherein a lifting of the second blade section does not lift the first blade section off of the small print head assembly orifice area during a wiping action of the first blade section.

* * * * *